US005284104A

United States Patent [19]

Hori et al.

[11] Patent Number: 5,284,104

[45] Date of Patent: Feb. 8, 1994

[54] EMBROIDERING MACHINE INCLUDING SEWING MACHINE AND EMBROIDERING UNIT CONNECTABLE TO SEWING MACHINE

[75] Inventors: Masayuki Hori, Gifu; Hideki Goto, Nagoya, both of Japan

[73] Assignee: Brother Kogyo Kabushiki Kaisha, Nagoya, Japan

[21] Appl. No.: 997,217

[22] Filed: Dec. 28, 1992

[30] Foreign Application Priority Data

Feb. 6, 1992 [JP] Japan ..... 4-56713

[51] Int. Cl.[5] ..... D05B 21/00

[52] U.S. Cl. ..... 112/121.12; 112/103

[58] Field of Search ..... 112/121.12, 121.11, 112/103, 220, 221, 102, 78, 277

[56] References Cited

U.S. PATENT DOCUMENTS 4,299,182 11/1981 Tanaka ..... 112/277
4,391,211 7/1983 Yamamoto et al. ..... 112/121.12
4,459,926 7/1984 Ohniwa ..... 112/121.12

FOREIGN PATENT DOCUMENTS 57-24305 5/1982 Japan .

*Primary Examiner*—Peter Nerbun
*Attorney, Agent, or Firm*—Oliff & Berridge

[57] ABSTRACT

An embroidering machine comprised of a common electronic sewing machine having a first controller and an embroidering unit detachably connected to the electronic sewing machine. The operating speed of a main motor of the electronic sewing machine is controlled according to a feed by which an embroidery frame holding a workpiece is moved when forming a stitch of an embroidery pattern. The embroidering unit has a second controller which generates a speed control signal relevant to the feed by which the embroidery frame is moved to form a stitch, the speed control signal is applied through a signal line and a connector to the first controller of the electronic sewing machine, and the first controller controls the operating speed of the main motor according to the speed control signal.

17 Claims, 11 Drawing Sheets

Fig.12B

| ITEM | INSTRUCTIONS |
|---|---|
| S10 | READ THE NUMBER OF A DESIRED EMBROIDERY PATTERN |
| S11 | PT ← 1 |
| S12 | READ STITCH DATA OF FIVE STITCHES INCLUDING STITCH DATA SPECIFIED BY PT |
| S13 | DETERMINE THE MAXIMUM FEED D |
| S14 | PROVIDE A SPEED CONTROL SIGNAL CORRESPONDING TO THE MAXIMUM FEED D |
| S15 | IS PHASE SIGNAL LOW ? |
| S16 | DRIVE THE STEPPING MOTORS 75 AND 76 |
| S17 | STOP COMMAND ? |
| S18 | PT ← (PT + 1) |
| S19 | HAVE ALL THE STITCHES BEEN FORMED ? |
| S20 | PROVIDE A SPEED CONTROL SIGNAL V5 |

Fig.13

| Max. feed D (mm) | SCS | Operating speed (rpm) |
|---|---|---|
| 0 to 2.9 | V1 | 400 |
| 3.0 to 4.4 | V2 | 300 |
| 4.5 to 9.8 | V3 | 150 |
| 9.9 to 12.7 | V4 | 110 |
| 12.8 or above | V5 | 0 |

EMBROIDERING MACHINE INCLUDING SEWING MACHINE AND EMBROIDERING UNIT CONNECTABLE TO SEWING MACHINE

BACKGROUND OF THE INVENTION

1. Field of the Invention

The invention relates to an embroidering machine and, more particularly, to an embroidering machine, provided with a main motor and a detachable embroidering unit having an embroidery frame, capable of controlling the operating speed of the main motor according to the movement of the embroidery frame.

2. Description of Related Art

There have been proposed various mechanically or electronically controlled embroidering machines, provided with an embroidering unit having an embroidery frame for holding a workpiece, for stitching embroideries by the cooperative effect of the vertical reciprocation of a needle bar and the horizontal movement of the embroidery frame.

An embroidering machine proposed in, for example, Japanese Utility Model Publication (Kokoku) No. Sho 57-24305 comprises a presser bar, a presser foot support plate attached to the lower end of the presser bar, a presser foot pivotally supported on the presser foot support plate, a presser lever extending obliquely upward from the presser foot and capable of engaging the horizontal shaft of a needle clamp, a magnet provided on the presser foot support plate so as to swing in synchronism with the vertical movement of the needle bar, a reed switch disposed near and above the magnet so that the output signal thereof remains HIGH (ON signal) during a period from a moment when the needle bar reaches its uppermost position to a moment when the presser foot presses a workpiece to allow the embroidery frame of an embroidering unit to be moved during the period in which the output signal of the reed switch is HIGH.

The embroidery frame of this embroidering machine is able to move while the output signal of the reed switch is HIGH, and the operating speed of the main motor is set by operating the speed volume of the embroidering machine independently of the feed of the workpiece. Because the period in which the output signal of the reed switch is HIGH is very short, the operating speed of the main motor must be held at a relatively low speed to ensure that the embroidery frame can be surely shifted during the period even if the feed of the workpiece is relatively large.

SUMMARY OF THE INVENTION

It is an object of the invention to provide an embroidering machine capable of operating for embroidering at a high efficiency by controlling the operating speed of the main motor in connection with the feed of a workpiece and greatly increasing the period for the movement of the embroidery frame.

To achieve the object, an embroidering machine having a sewing machine and an embroidering unit detachably connected to the sewing machine for enabling embroidering operation, the embroidering machine of the invention comprising:

stitch forming means provided in the sewing machine for forming a stitch, the stitch forming means including a loop catcher and a needle bar having a needle at a lower end thereof;

a main motor provided in the sewing machine for driving the stitch forming means;

speed control means provided in the sewing machine for controlling the main motor based on a speed control signal;

an embroidery frame provided in the embroidering unit for holding a workpiece;

moving means provided in the embroidering unit for moving the embroidery frame in a horizontal plane;

storing means provided in the embroidering unit for storing feed data representing a feed of the embroidery frame necessary for forming each of stitches of a plurality of embroidery patterns;

feed control means provided in the embroidering unit for controlling the moving means and for generating a speed control signal based on feed data stored by the storing means; and first connecting means for connecting the speed control means of the sewing machine to the feed control means of the embroidering unit so as to transmit a speed control signal generated by the feed control means to the speed control means.

In the embroidering machine of the invention, the feed control means of the embroidering unit generates a speed control signal in connection with the feed on the basis of the feed data representing the feed of the workpiece supplied from the storing means for each workpiece feed cycle. The speed control signal is given through the first connecting means to the speed control means of the sewing machine. The speed control means controls the main motor according to the speed control signal.

Thus, the speed control signal generated by the feed control means of the embroidering unit is given through the first connecting means to the speed control means of the sewing machine and the main motor is controlled according to the speed control signal, so that the main motor operates at a higher operating speed for a smaller feed to improve the efficiency of the embroidering machine.

BRIEF DESCRIPTION OF THE DRAWINGS

The above and other objects, features and advantages of the invention will become more apparent from the following description taken in connection with the accompanying drawings, in which:

FIG. 12B is a table of labels for the flowchart of FIG. 12A; and

FIG. 13 is a speed signal table representing the relationship between a maximum feed and a speed control signal.

DETAILED DESCRIPTION OF THE PREFERRED EMBODIMENT

An embodiment of an embroidering machine SM according to the invention comprises an electronic zigzag sewing machine M and an embroidering unit 20 that is detachably combined with the electronic zigzag sewing machine M. The operating speed of the electronic zigzag sewing machine M can be controlled by means of a pedal-operated controller. The electronic zigzag sewing machine M of the embroidering machine SM will be described.

Figure 1:
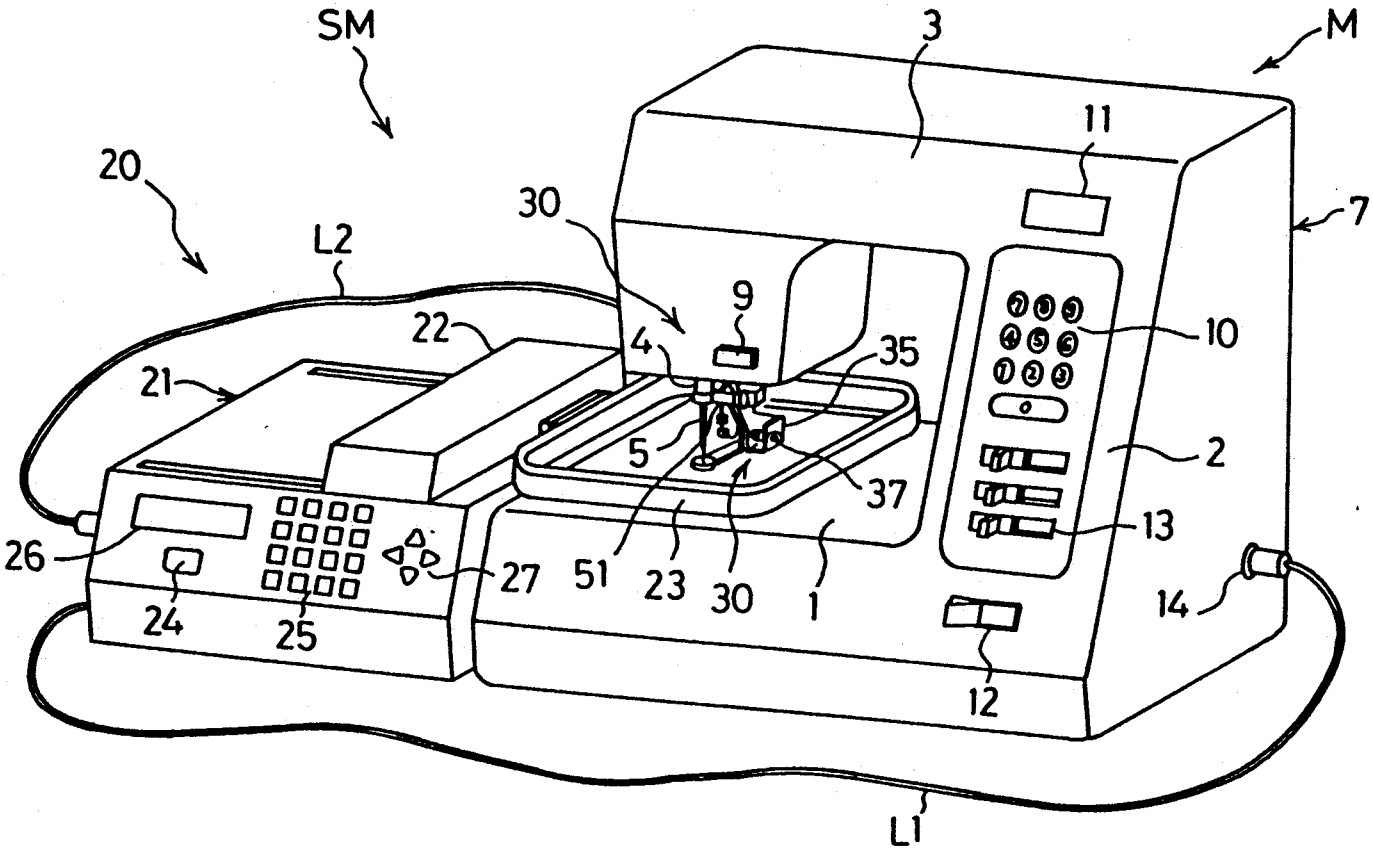
FIG. 1 is a perspective view of an embroidering machine.

Referring to FIG. 1, the electronic zigzag sewing machine M has a bed 1, a column 2 extending upright from the right-hand end, as viewed in FIG. 1, of the bed 1, and an arm 3 horizontally extending to the left from the upper end of the column 2. A feed dog lifting mechanism (not shown), a lengthwise feed mechanism (not shown) and a loop catcher (not shown) are contained in the bed 1. A needle bar driving mechanism (not shown), for vertically reciprocating a needle bar 4 holding a needle 5 at its lower end, a needle bar rocking mechanism (not shown), for rocking the needle bar 4 in directions perpendicular to a workpiece feed direction and a thread take-up lever driving mechanism (not shown), for turning a thread take-up in a vertical plane in synchronism with the vertical movement of the needle bar 4, are provided on the arm 3. A presser bar 6 (FIGS. 2–5 and 7–9) is supported for vertical movement behind the needle bar 4 on a frame 7. The feed dog lifting mechanism, the needle bar driving mechanism and the thread take-up driving mechanism are driven by a main motor 61, the lengthwise feed mechanism is driven by a stepping motor 63 and the needle bar rocking mechanism is driven by a stepping motor 62.

A start-stop switch 9 for starting and stopping the sewing operation is provided on the front wall of the arm 3. Pattern selector switches 10, i.e., numeric key switches, a 7-segment LED display 11 for displaying the number of a selected pattern by two digits and a speed adjusting knob 13, for adjusting sewing speed, are arranged on the front wall of the column 2. A connector 14 for connecting a pedal-operated controller, not shown, to the electronic zigzag sewing machine M is provided on the side wall of the column 2.

An embroidering unit 20 is detachably connected to the left-hand end of the bed 1 of the electronic zigzag sewing machine M. When the embroidering unit 20 is attached to the electronic zigzag sewing machine M, the pedal-operated controller is disconnected from the connector 14 and the embroidering unit 20 is connected to the connector 14 instead of the pedal-operated controller.

The embroidering unit 20 has an embroidery frame 23 for holding a workpiece W. The embroidery frame 23 moves in a horizontal plane on the bed 1. The embroidering unit 20 will be described.

The embroidering unit 20 has an embroidery table 22 mounted on a main frame 21 thereof for movement in parallel to a Y-axis parallel to the longitudinal feed direction and for movement in parallel to an X-axis perpendicular to the Y-axis. The embroidery frame 23, for holding the workpiece W, is detachably mounted on the embroidery table 22.

A first stepping motor 75 for driving the embroidery table 22 for movement in parallel to the X-axis and a second stepping motor 76 for driving the embroidery table 22 for movement in parallel to the Y-axis are provided within the main frame 21. The stepping motors 75 and 76 are driven by driving signals to move the embroidery table 22 in parallel to the X-axis and the Y-axis when stitching embroideries on the workpiece W in cooperation with the vertical movement of the needle bar 4.

Further, there are provided a start-stop switch 24 for starting and stopping the embroidering operation, pattern selector switches 25, i.e., numeric key switches, for specifying the number of a desired pattern, a 7-segment LED display 26 for displaying the number of a selected pattern, and embroidery frame moving key switches 27 which are operated by the operator to shift the embroidery frame 23 in directions parallel to the X-axis and the Y-axis, all found on the front wall of the main frame 21.

Referring to FIGS. 1 to 5, the presser foot unit 30 attached to the lower end of the presser bar 6 comprises an embroidering presser foot 40, a presser foot holding mechanism 31 holding the embroidering presser foot 40 at the lower end of the presser bar 6, and a phase signal generating device 32.

The presser foot holding mechanism 31 has a substantially U-shaped presser foot holding member 35 having a lug 35*a*, for detachably fastening the presser foot holding mechanism 31 to the lower end of the presser bar 6 with a screw 36, and opposite support arms 35*b* and 35*c* supporting a shaft 37 at its opposite ends in a horizontal position. The shaft 37 is held in place in the opposite support arms 35*b* and 35*c* of the presser foot holding member 35 with snap rings 38.

A substantially U-shaped first swing lever 39 has a support portion 39*a* extending on the outer side of the support wall 35*b*, and a lever portion 39*b* extending obliquely upward. The first swing lever 39 is supported swingably at the lower end of the lever portion 39*b* on the presser foot support member 35 by the shaft 37. The embroidering presser foot 40 is formed integrally with the first swing lever 39 so as to extend longitudinally from the lower end of the first swing lever 39. The embroidering presser foot 40 swings together with the first swing lever 39. The embroidering presser foot 40 is provided with a needle hole 40*a* for receiving the needle 5 therethrough.

Figure 2:
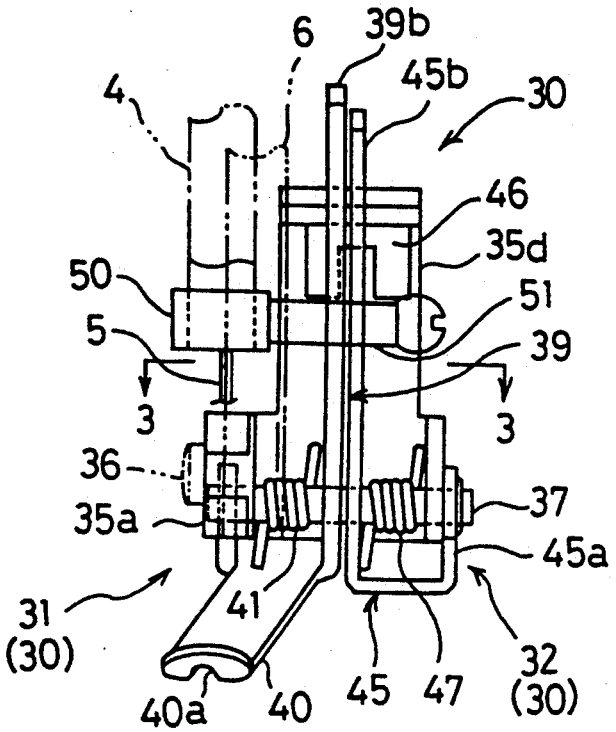
FIG. 2 is a front view of a presser foot unit.
Figure 3:
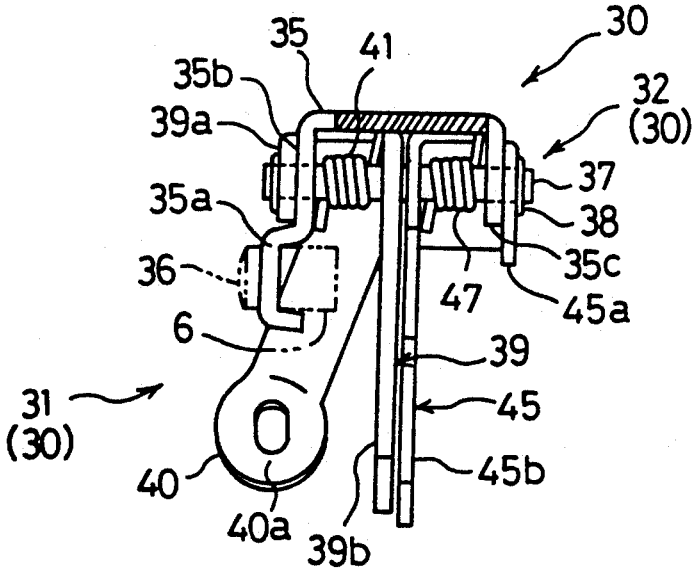
FIG. 3 is a longitudinal sectional view taken on line 3—3 in FIG. 2.
Figure 4:
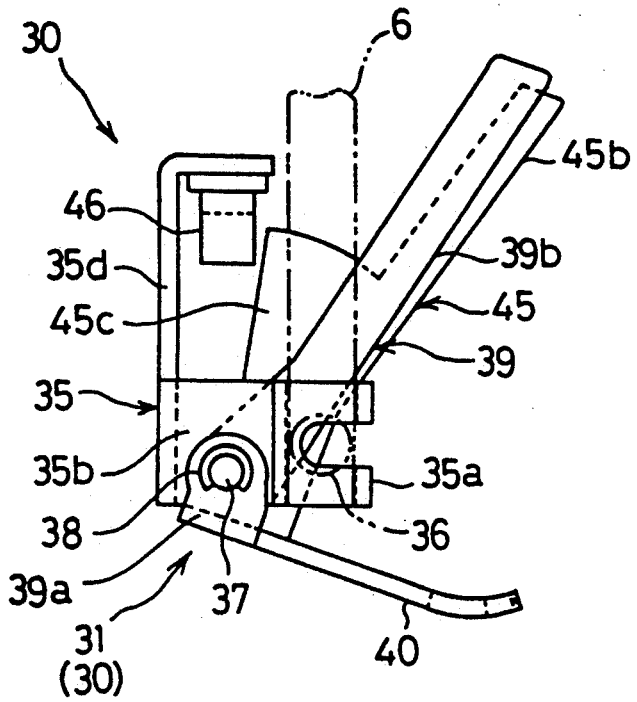
FIG. 4 is a left-hand side view of the presser foot unit.

As shown in FIGS. 2 and 3, a torsion coil spring 41 is mounted on the left end of the shaft 37 (as viewed in the figures). The torsion coil spring 41 has one end engaging the presser foot support member 35 and the other end engaging the embroidering presser foot 40 to bias the first swing lever 39 and the embroidering presser foot 40 continuously in a clockwise direction around shaft 37, as viewed in FIG. 4. The embroidering presser foot 40 is pressed resiliently against the workpiece W by the torsion coil spring 41 to apply pressure to the workpiece W. The clockwise turning of the first swing lever 3 is limited by the presser foot support member 35.

The phase signal generating device 32 will be described hereinafter. A substantially U-shaped second swing lever 45 has a support portion 45*a* positioned on the outer side of the support arm 35*c* and a lever portion 45*b* extending obliquely upward. The shaft 37 extends across the lower end of the lever portion 45*b* to swingably support the second swing lever 45 on the presser foot support member 35.

The presser foot support member 35 has a vertical arm 35*d* having an upper end bent toward the front. A photodetector 46 consisting of a light emitting device and a light receiving device is attached to the lower surface of the bent portion of the vertical arm 35*d*.

Figure 5:
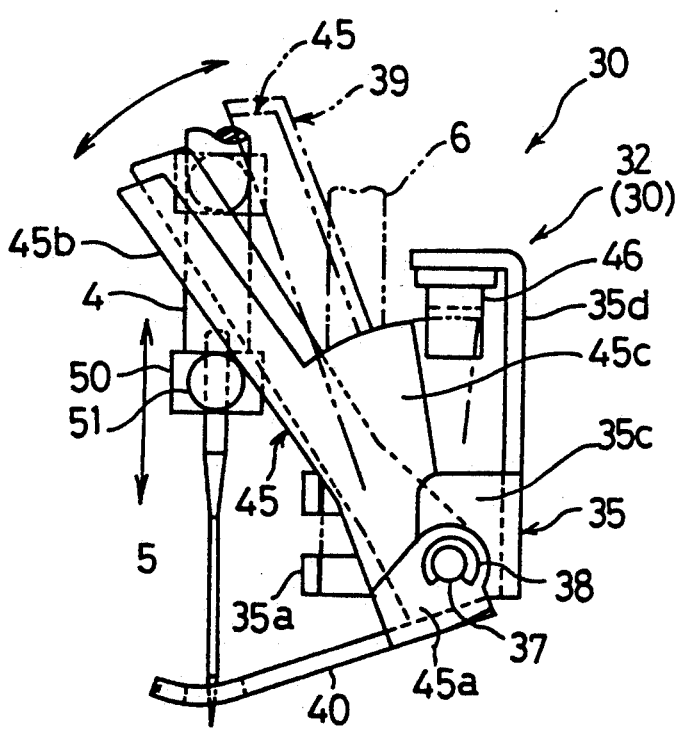
FIG. 5 is a right-hand side view of the presser foot unit.
Figure 6:
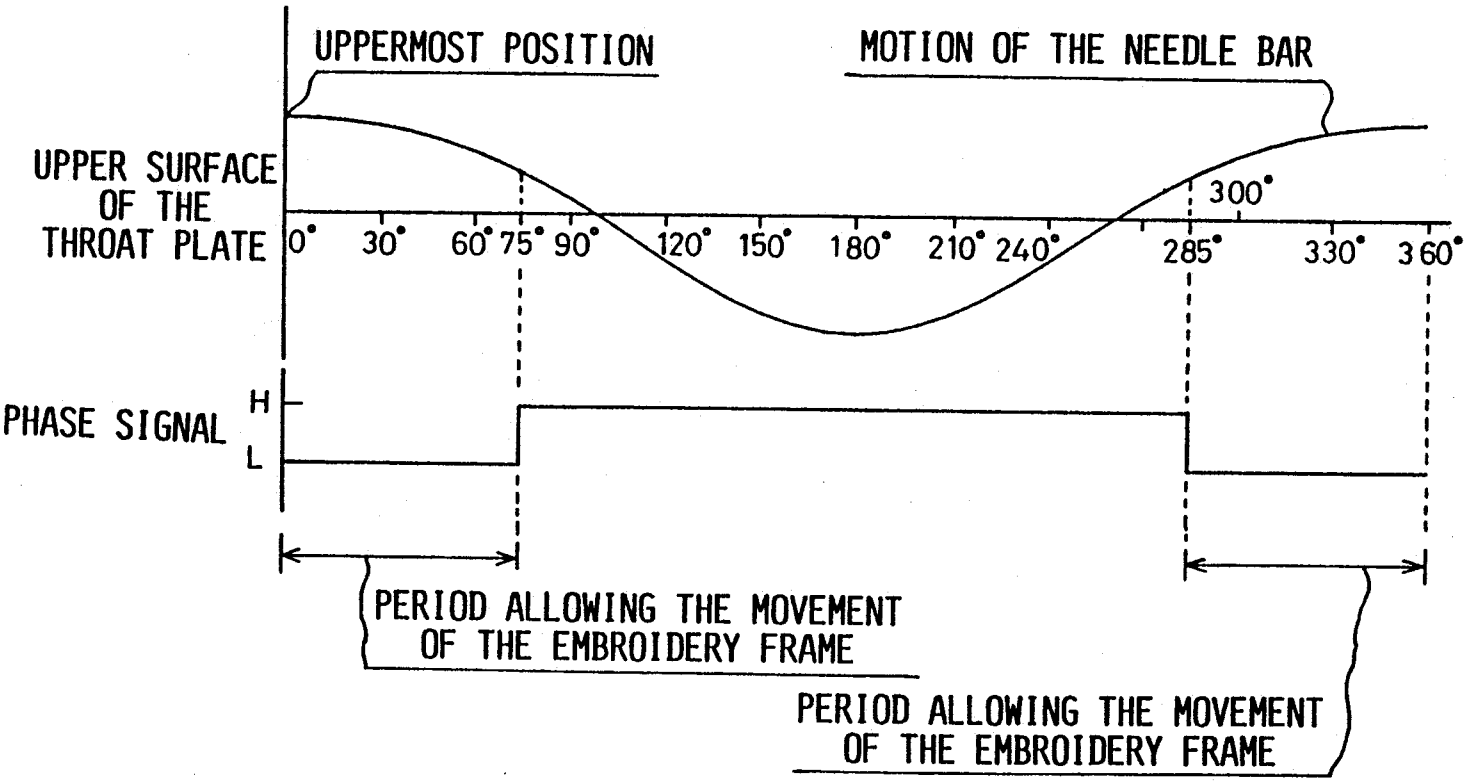
FIG. 6 is a timing chart of timing for the operation of a needle bar according to a phase signal.

As is best shown in FIG. 5, an intercepting member 45*c*, having a substantially sectorial shape, for intercepting the light traveling from the light emitting device toward the light receiving device of the photodetector 46 is formed integrally with the second swing lever 45 so as to project rearward, i.e., to the right as viewed in FIG. 5, from a portion of the rear edge of the lever portion 45*b* between the lower end and the middle point of the same.

Referring to FIGS. 2 and 3, a torsion coil spring 47 is mounted on the right end of the shaft 37. The torsion coil spring 47 has one end engaging the presser foot support member 35 and the other end engaging the second swing lever 45 to bias the second swing lever 45*a* continuously counterclockwise direction around shaft 37, as viewed in FIG. 5. The counterclockwise turning of the second swing lever 45 is limited by the presser foot support member 35. Thus, both the first swing lever 39 and the second swing lever 45 are biased, respectively, by torsion coil springs 41, 47 in the same direction.

A needle clamp 50 is fastened to the lower end of the needle bar 4. A needle clamping rod 51 is screwed in the needle clamp 50 to fasten the shank of the needle 5 to the needle bar 4. As shown in FIG. 2, the needle clamping rod 51 extends laterally across the lever portions 39*b* and 45*b*. The lever portions 39*b* and 45*b* are caused to swing on the shaft 37 by the needle clamping rod 51 as shown in FIG. 5 according to the vertical movement of the needle bar 4. In FIG. 5, the respective positions of the swing levers 39, 45 when the needle bar 4 is at its uppermost position are indicated by alternate long and two short dashes lines and the respective positions of the swing levers 39, 45 when the tip of the needle 5 is just about to penetrate the workpiece W are indicated by continuous lines.

Figure 7:
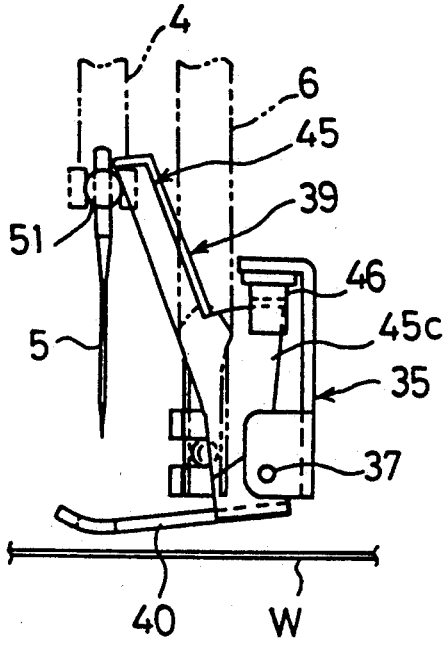
FIG. 7 is a side view, similar to FIG. 5, of the presser foot unit in a state in which the needle bar is at its uppermost position and the phase is about 0°.
Figure 8:
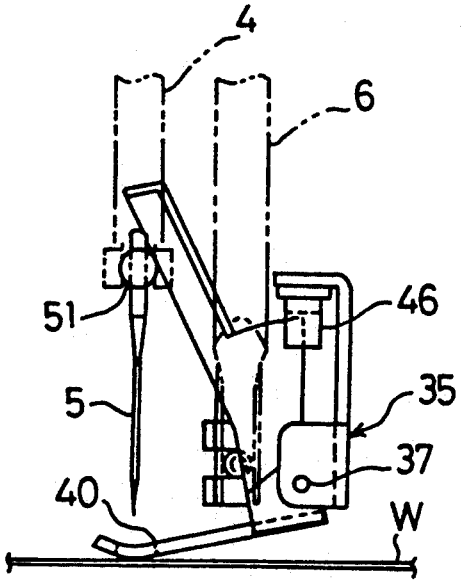
FIG. 8 is a side view, similar to FIG. 5, of the presser foot unit in a state in which the phase is about 75°.
Figure 9:
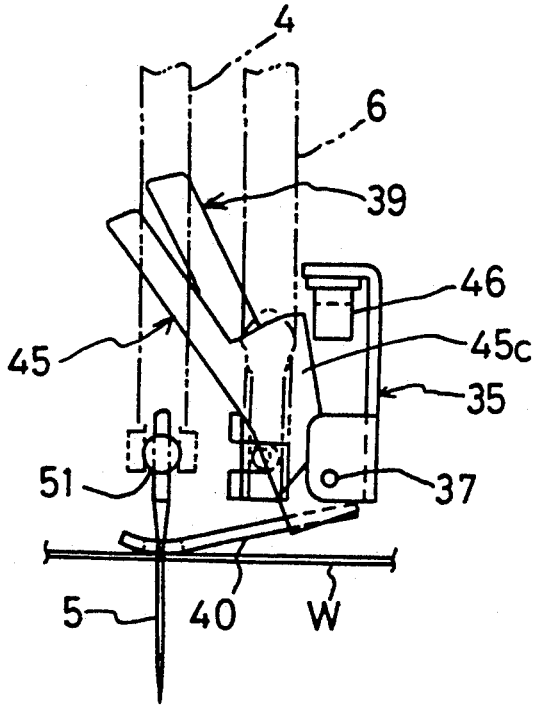
FIG. 9 is a side view, similar to FIG. 5, of the presser foot unit in a state in which the needle bar is at its lowermost position and the phase is about 180°.

FIG. 7 shows a state of the presser foot unit 30 when the needle bar 4 is at its uppermost position, i.e., when the phase is 0°. In this state, a light beam emitted by the light emitting device of the photodetector 46 is intercepted by an intercepting member 45*c*. FIG. 8 shows a state of the presser foot unit 30 when the phase is about 75° at which time the needle bar 4 is being lowered from the uppermost position and the intercepting member 45*c* is just about to leave the path of the light beam. FIG. 9 shows a state of the presser foot unit 30 when the phase is 180° at which the needle bar 4 is at its lowermost position and the intercepting member 45*c* has been completely moved away from the path of the light beam.

Referring to FIGS. 6 to 9, a phase signal PS generated by the photodetector 46 is LOW in a period from phase of 0° to phase of 75°, the phase signal PS is HIGH in a period from phase of 75° to phase of about 285° at which the needle 5 is separated from the workpiece W and the workpiece W can be moved, and the phase signal PS goes LOW again in a period from phase of about 285° to phase of 360°. Thus, the phase signal PS generated by the photodetector 46 remains LOW in a period from phase of 285° to phase of 360°, i.e., a first half embroidery frame moving period, and in a period from phase of 0° to phase of 75°, i.e., a second half embroidery frame moving period.

Figure 10:
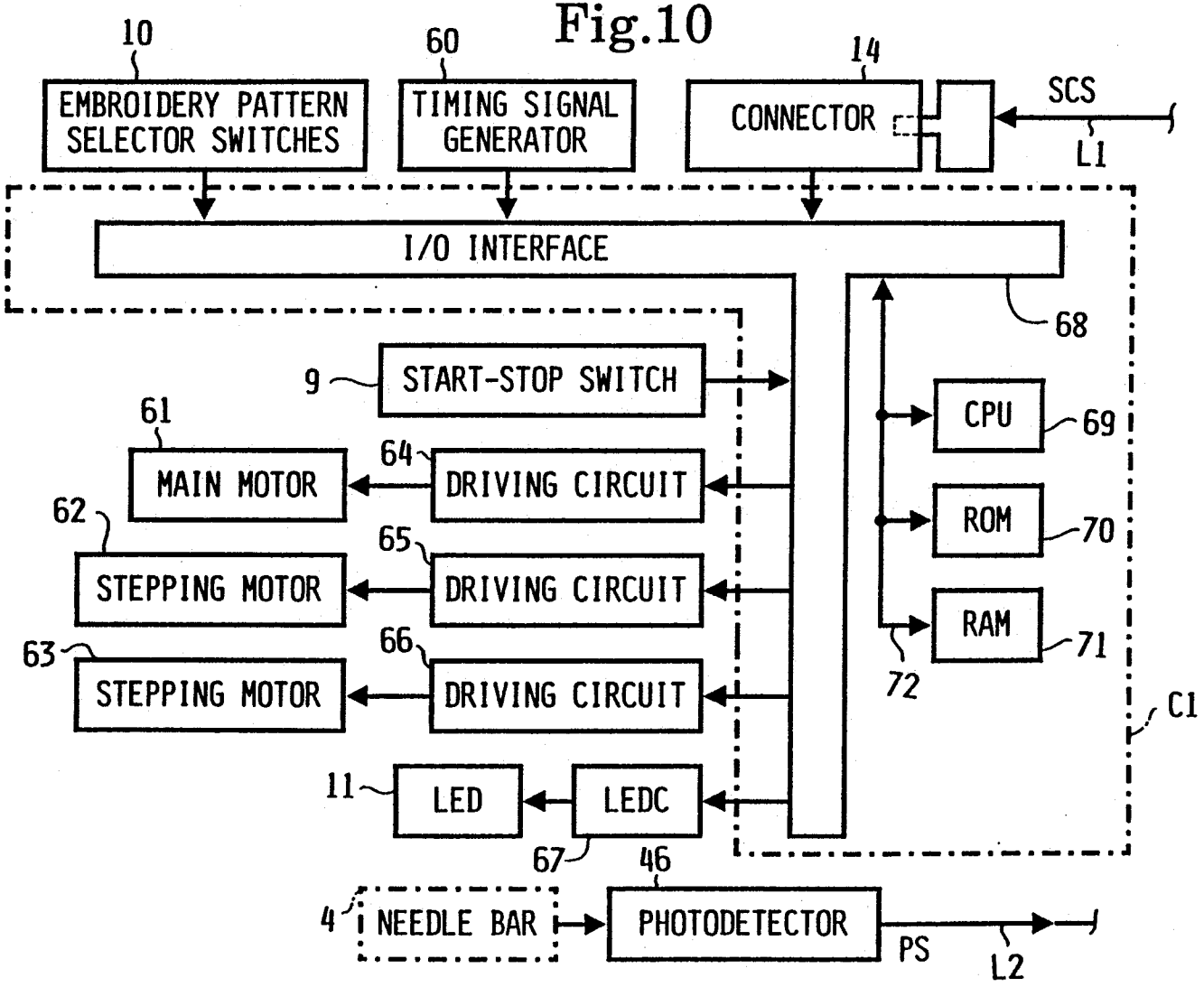
FIG. 10 is a block diagram of a control system for controlling an electronic zigzag sewing machine.

A control system for controlling the electronic zigzag sewing machine M will be described hereinafter with reference to FIG. 10.

A first controller C1 comprises a CPU 69, an I/O interface 68 connected to the CPU 69 by a bus 72, a ROM 70 and a RAM 71.

The start-stop switch 9, the pattern selector switches 10, a timing signal generator 60 and the connector 14 are connected to the I/O interface 68. Also connected to the I/O interface 68 are a driving circuit 64 for driving the main motor 61, a driving circuit 65 for driving the stepping motor 62 for reciprocating the needle bar 4, a driving circuit 66 for driving the stepping motor 63 for driving the feed dog, and an LED display controller (LEDC) 67 for driving the LED display 11.

Stored in the ROM 70 are stitch data specified by pattern codes and representing seaming stitches and stitch patterns, pattern stitching control programs for controlling the stitching operation according to the stitch data of a selected stitch pattern, control programs for controlling the operation of the motors 61, 62 and 63, a display control program for controlling the LED display 11, a main motor control program for controlling the operating speed of the main motor according to a speed control signal SCS given through the signal line L1 and the connector 14 to the first controller C1 by the embroidering unit 20, and other programs necessary for controlling the operation of the electronic zigzag sewing machine M.

The RAM 71 has a memory for temporarily storing the results of operation of the CPU 69, memories for storing flags and pointers and memories serving as counters.

Figure 11:
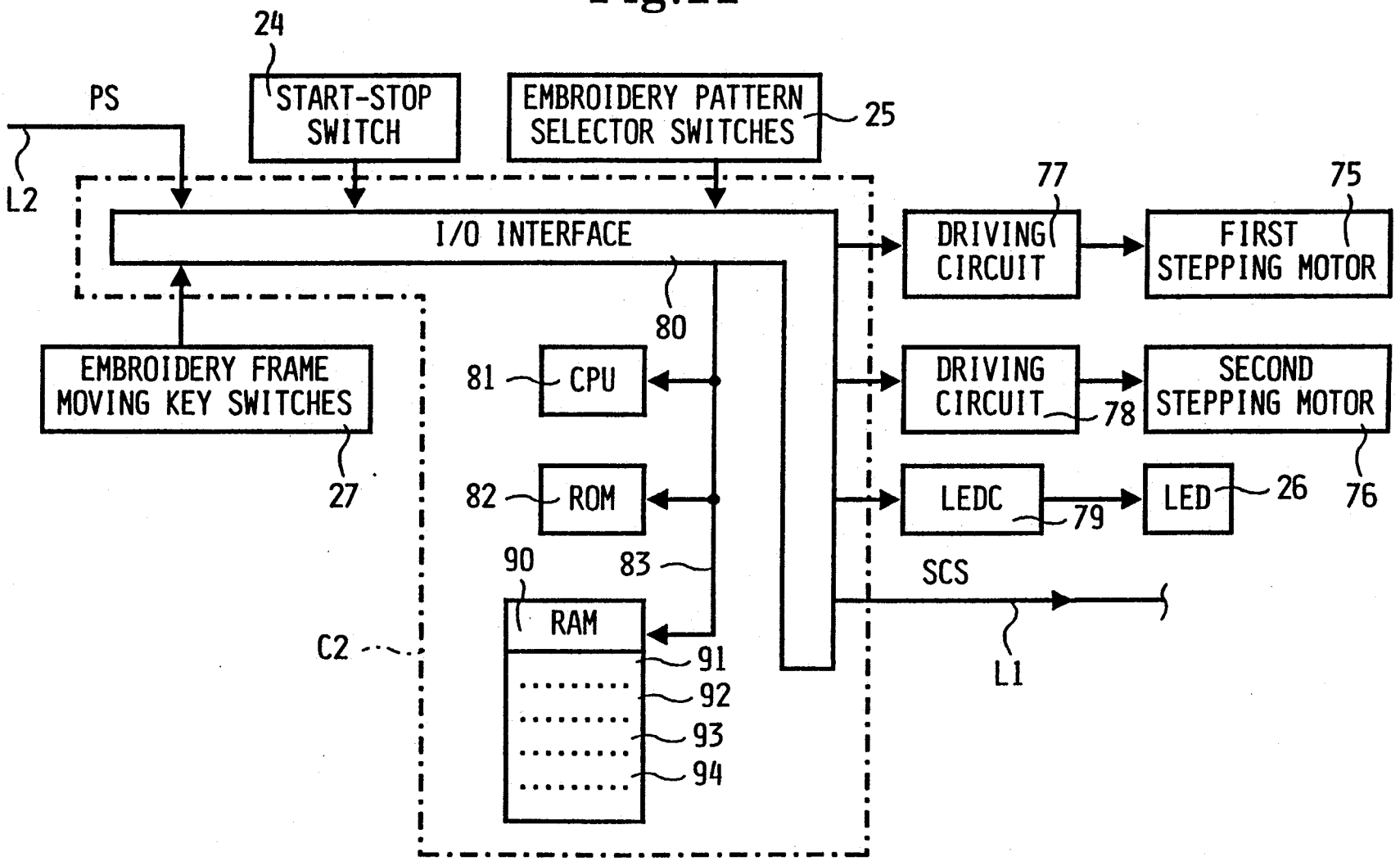
FIG. 11 is a block diagram of a control system for controlling an embroidering unit.

A control system for controlling the embroidering unit 20 will be described hereinafter with reference to FIG. 11.

A second controller C2 comprises a CPU 81, an I/O interface 80 connected by a bus 83 to the CPU 81, a ROM 82 and a RAM 90. The phase signal PS generated by the photodetector 46 is applied through the signal line L2 to the I/O interface 80, and the speed control signal SCS is transferred through the I/O interface 80 and the signal line L1 to the connector 14. The start-stop switch 24, the pattern selector switches 25, the embroidery frame moving key switches 27, a driving circuit for driving the first stepping motor 75, a driving circuit 78 for driving the second stepping motor 76 and a LED display controller (LEDC) 79 for controlling the LED display 26 are connected to the I/O interface 80.

Stored in the ROM 82 are stitch data specified by pattern codes and representing a plurality of embroidery patterns, embroidery control programs for controlling the embroidering operation for stitching a selected embroidery pattern including embroidery control programs featuring the invention, and drive control programs for controlling the operation of the motors 75 and 76.

Also stored in the ROM 82 are a speed control program for generating the speed control signal SCS and a speed signal table, as shown in FIG. 13.

The speed signal table specifies speed control signals SCS representing the operating speed of the main motor 61, i.e., the rotating speed (rpm) of the output shaft of the main motor 61 for maximum feeds D with respect to directions parallel to the X-axis and the Y-axis. The speed control signals SCS are voltage signals corresponding, respectively, to voltages to be applied to the main motor 61. In the table of FIG. 13, V1>V2>V3>V4>V5, in which V5=0V.

The RAM 90 has a number memory 91 for storing the embroidery pattern number of a selected embroidery pattern, a data memory 92 for storing stitch data of five stitches, a pointer memory 93 for storing a pointer PT specifying stitch data to execute embroidering, a speed signal memory 94 for storing data representing the speed control signals SCS to be applied to the electronic zigzag sewing machine M, a memory for temporarily storing the results of operation of the CPU 81, and memories for flags, counters and pointers.

Figure 12A:
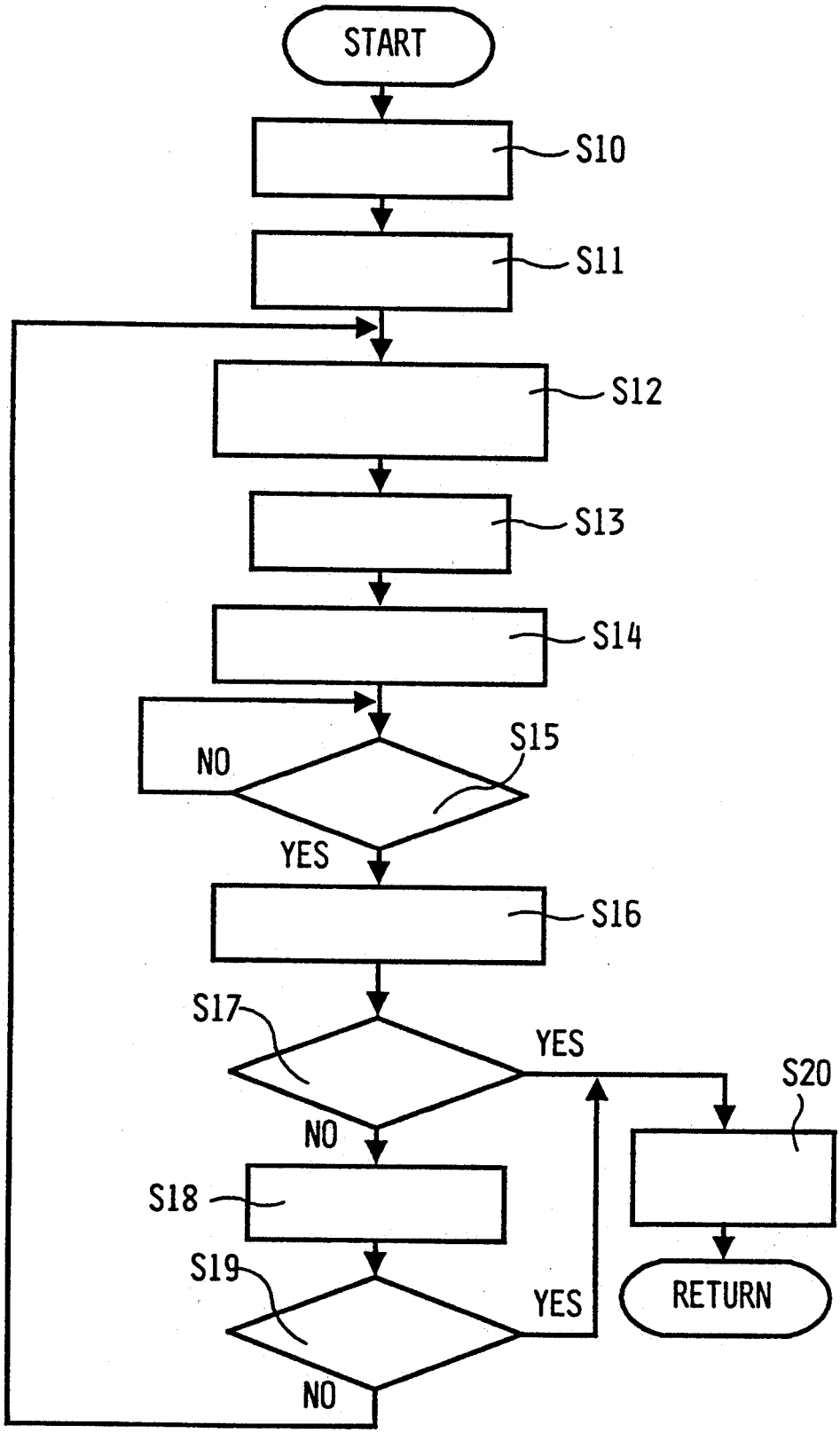
FIG. 12A is a flowchart of a control routine for controlling an embroidering operation.

The operation of the second controller C2 will be described hereinafter with reference to FIG. 12, in which reference characters Si (i=10, 11, 12, . . . n) indicate steps of the control routine.

The embroidery frame moving key switches 27 are operated to locate the embroidery frame 23 at a starting position, that is, where a desired stitching starting point on the workpiece W held on the embroidery frame 23 is located directly below the needle 5. The embroidery pattern selector switch 25 is operated to select a desired embroidery pattern and the embroidery pattern number of the selected embroidery pattern is stored in the number memory 91. The electronic zigzag sewing machine M is set for a straight seaming mode and the needle 5 is located for straight seaming before the second controller C2 starts the control operation.

Then, the start-stop switch 24 is operated to actuate the second controller C2. The embroidery pattern number of the selected embroidery pattern is read from the memory 91 in step S10 and a pointer PT=1 is stored in pointer memory 93 in step S11. Then, stitch data for five stitches, including stitch data specified by the pointer PT, among the stitch data specified by the embroidery pattern number is read and stored in the data memory 92 in step S12 and a maximum feed D corresponding to the stitch data stored in the data memory 92 is retrieved from the speed signal table in step S13. Each stitch data includes a feed in the direction of the X-axis and a feed in the direction of the Y-axis, and the maximum feed D is the largest feed among those of the five stitches in the X-direction and the Y-direction.

In step S14, a speed control signal SCS corresponding to the maximum feed D is read from the speed signal table and transferred through the I/O interface 80, the signal line L1 and the connector 14 to the first controller C1. Then, the electronic zigzag sewing machine M starts the embroidering operation while the first controller C1 controls the operating speed of the main motor 61 according to the speed control signal SCS. In step S15, a query is made to see if the phase signal PS applied to the I/O interface 80 is LOW. If the response in step S15 is affirmative, i.e., a period in which the embroidery frame 23 can be moved, the stepping motors 75 and 76 are driven according to the stitch data specified by the pointer PT in step S16 to move the embroidery frame 23 to the next stitching position.

In step S17, a query is made to see if the start-stop switch 24 is operated and a stop command is being given. If the response in step S17 is negative, the pointer PT is incremented by one in step S18. Then, a query is made in step S19 to see if there is any stitch data corresponding to the pointer PT, i.e., if stitching operation for all the stitch data has been completed. If the response in step S19 is negative, step S12 and the following steps are repeated. Since the operating speed of the main motor 61 is controlled by the speed control signal SCS corresponding to the maximum feed D among feeds for the five stitches, the embroidery frame 23 can be surely moved from one stitching position to the next stitching position within the period allowing for the movement of the embroidery frame 23.

If the response in step S17 is affirmative, i.e., if the start-stop switch 24 is operated to enter a stop command, or if the response in step S19 is affirmative, the speed control SCS of V5 is provided in step S20 to end the control program and, consequently, the main motor 61 is stopped to end the embroidery stitching operation.

As is apparent from the foregoing description, since the main motor 61 is controlled according to the speed control signal generated by the second controller C2 of the embroidering unit 20 and given through the signal line L1 to the first controller C1 of the electronic zigzag sewing machine M, the operating speed of the main motor 61 is increased for a smaller maximum feed D to improve the efficiency of embroidering operation.

Furthermore, since the phase signal PS generated by the phase signal generating device 32 and given through the signal line L2 to the second control unit C2 specifies an increased period allowing for the movement of the embroidery frame 23, in which the needle bar 4 moves toward and past its uppermost position, the main motor 61 may be operated at relatively high operating speeds to improve the efficiency of the embroidering operation.

The maximum feed D may be the maximum vector sum of a feed in the direction of the X-axis and a feed in the direction of the Y-axis for a stitch among those for the five stitches.

Although the invention has been described in its preferred form with a certain degree of particularity, obviously many changes and variations are possible therein. It is therefore to be understood that the invention may be practiced otherwise than as specifically described herein without departing the scope and spirit thereof.

What is claimed is:

1. An embroidering machine having a sewing machine and an embroidering unit detachably connected to the sewing machine for enabling embroidering operation, the embroidering machine comprising:

stitch forming means provided in the sewing machine for forming a stitch, the stitch forming means including a loop catcher and a needle bar having a needle at a lower end thereof;

a main motor provided in the sewing machine for driving the stitch forming means;

speed control means provided in the sewing machine for controlling the main motor based on a speed control signal;

an embroidery frame provided in the embroidering unit for holding a workpiece;

moving means provided in the embroidering unit for moving the embroidery frame in a horizontal plane;

storing means provided in the embroidering unit for storing feed data representing a feed of the embroidery frame necessary for forming each of stitches of a plurality of embroidery patterns;

feed control means provided in the embroidering unit for controlling the moving means and for generating a speed control signal based on feed data stored by the storing means; and first connecting means for connecting the speed control means of the sewing machine to the feed control means of the embroidering unit so as to transmit a speed control signal generated by the feed control means to the speed control means.

2. The embroidering machine according to claim 1, further comprising:

phase signal generating means provided in the sewing machine for generating a phase signal identifying a predetermined period allowing for the movement of the embroidery frame holding the workpiece, in which the needle is separated from the workpiece; and second connecting means for connecting the phase signal generating means of the sewing machine to the feed control means of the embroidering unit so as to transmit the phase signal generated by the phase signal generating means to the feed control means, wherein the feed control means controls the moving means such that the moving means moves the embroidery frame while the phase signal is generated.

3. The embroidering machine according to claim 2, further comprising:

a presser bar provided in the sewing machine, the presser bar having a presser foot, wherein the phase signal generating means is provided on the presser bar.

4. The embroidering machine according to claim 1, wherein the first connecting means connects a pedal-operated controller to the sewing machine instead of the speed control means when the embroidering unit is detached from the sewing machine.

5. The embroidering machine according to claim 1, wherein said feed control means generates said speed control signal by reading feed data of a predetermined number of stitches stored in said storing means, determines a maximum feed value from the feed data and determines the speed control signal based on the maximum feed value.

6. An embroidering machine including a sewing machine which has a bed and a main motor for sewing embroidery patterns, comprising:

an embroidering unit detachably connected to the sewing machine, said embroidering unit having:

an embroidery frame extending over the bed of the sewing machine for holding a workpiece;

moving means for moving said embroidery frame in a horizontal plane over the bed;

storing means for storing movement data representing movement of the embroidery frame in the horizontal plane for forming each stitch of a plurality of embroidery patterns; and movement control means for controlling said moving means and for generating a speed control signal based on the movement data; and first connecting means for connecting said movement control means to the sewing machine, wherein the sewing machine has stitch forming means driven by the main motor at a speed designated by the speed control signal.

7. The embroidering machine according to claim 6, further comprising:

a phase signal generating mechanism in the sewing machine for generating a movement enabling signal when said embroidery frame may be moved; and second connecting means from the sewing machine to said embroidering unit for passing the movement enabling signal from said phase signal generating means to said movement controlling means.

8. The embroidering machine according to claim 7, further comprising a presser foot for fixing the workpiece against a feed mechanism in the bed of the sewing machine when the phase signal generating mechanism generates a movement preventing signal that prevents movement of said embroidery frame.

9. The embroidering machine according to claim 8, wherein said phase signal generating mechanism and said presser foot comprise a presser foot unit.

10. The embroidering machine according to claim 7, wherein the phase signal generating mechanism comprises:

a detector arm having a sectorial extension extending from one side thereof;

detector means for detecting the presence of said sectorial extension; and moving means for moving said detector arm between a first position and a second position such that said detector means detects said sectorial extension during a portion of movement to and from the first position.

11. The embroidering machine according to claim 8, wherein the presser foot comprises:

a foot;

a presser arm extending at substantially a right angle from one end of said foot; and moving means for moving said arm between a first position and a second position where the workpiece is fixed against the feed mechanism.

12. The embroidering machine according to claim 9, wherein the presser foot unit comprises:

a detector arm having a sectorial extension extending from one side thereof;

detector means for detecting the presence of said sectorial extension;

moving means for moving said detector arm between a first position and a second position such that said detector means detects said sectorial extension during a portion of movement to and from the first position;

a foot;

a presser arm extending at substantially a right angle from one end of said foot; and said moving means further moving said presser arm between a first position and a second position where the workpiece is fixed against the feed mechanism.

13. The embroidering machine according to claim 12, said presser foot unit further comprising:

a presser foot support member; and a shaft mounted on said presser foot support member, wherein said presser arm and said detector arm are pivotally mounted on said shaft.

14. The embroidering machine according to claim 12, wherein said moving means comprises a rod attached to a needle bar of the sewing machine, an edge of each said arm riding on said rod.

15. The embroidering machine as claimed in claim 13, further comprising torsion means mounted to said shaft for biasing said presser arm and said detector arm toward the second position.

16. The embroidering machine according to claim 6, wherein said first connecting means connects a pedal-operated controller to said sewing machine instead of said movement control means when said embroidering unit is detached from said sewing machine.

17. The embroidering machine according to claim 6, wherein said movement control means generates said speed control signal by reading movement data of a predetermined number of stitches stored in said storing means, determines a maximum feed value from the movement data and determines the speed control signal based on the maximum feed value.

* * * * *